US008061341B2

(12) United States Patent
Hudkins

(10) Patent No.: US 8,061,341 B2
(45) Date of Patent: Nov. 22, 2011

(54) ARCHERY BOW QUIVER

(76) Inventor: Jason M. Hudkins, Rochester, IN (US)

( * ) Notice: Subject to any disclaimer, the term of this patent is extended or adjusted under 35 U.S.C. 154(b) by 209 days.

(21) Appl. No.: 12/536,685

(22) Filed: Aug. 6, 2009

(65) Prior Publication Data

US 2011/0030668 A1 Feb. 10, 2011

(51) Int. Cl.
*F41B 5/22* (2006.01)
*F41B 5/06* (2006.01)

(52) U.S. Cl. ..... 124/44.5; 124/86; 124/25.7; 224/584; 224/916; 248/685

(58) Field of Classification Search ..... 124/23.1, 124/25.7, 44.5, 86, 88, 41.1; 224/200, 584, 224/916; 248/217.4, 685; 211/85.7, 116, 211/168

See application file for complete search history.

(56) References Cited

U.S. PATENT DOCUMENTS

| | | | | | |
|---|---|---|---|---|---|
| 2,593,789 | A | * | 4/1952 | Pearson | 211/85.7 |
| 3,584,820 | A | | 6/1971 | Butcher, Sr. | |
| 3,777,734 | A | | 12/1973 | Rose | |
| 4,020,984 | A | * | 5/1977 | Morris | 124/88 |
| 4,066,051 | A | | 1/1978 | Alban | |
| 4,195,616 | A | | 4/1980 | Darlington | |
| 4,363,312 | A | | 12/1982 | Spitzke | |
| 4,522,187 | A | | 6/1985 | Tafel | |
| 4,621,606 | A | | 11/1986 | Toth | |
| 4,635,611 | A | | 1/1987 | Priebe | |
| 4,685,438 | A | | 8/1987 | Larson | |
| 4,704,800 | A | | 11/1987 | Stinson | |
| 4,788,961 | A | | 12/1988 | Toth | |
| 4,889,307 | A | | 12/1989 | Klansek | |
| 4,995,372 | A | | 2/1991 | Topel | |
| 5,039,052 | A | * | 8/1991 | Carafice | 248/309.1 |
| 5,063,678 | A | | 11/1991 | Simo | |
| 5,076,522 | A | * | 12/1991 | Stinson | 248/216.1 |
| 5,123,396 | A | | 6/1992 | Shepley et al. | |
| 5,265,584 | A | * | 11/1993 | Judson et al. | 124/86 |
| 5,310,150 | A | * | 5/1994 | Fecko | 248/218.2 |
| 5,437,377 | A | * | 8/1995 | Riemenschneider | 211/86.01 |
| 5,738,080 | A | * | 4/1998 | Brocco, Jr. | 124/86 |
| 5,967,475 | A | * | 10/1999 | Johnson | 248/217.4 |
| 6,006,734 | A | | 12/1999 | Sodaro | |
| 6,295,976 | B1 | * | 10/2001 | Runde | 124/86 |
| 6,330,881 | B1 | | 12/2001 | Pippard | |
| 6,561,477 | B1 | * | 5/2003 | Prive | 248/339 |
| 6,845,765 | B1 | | 1/2005 | Allshouse et al. | |

(Continued)

*Primary Examiner* — Gene Kim
*Assistant Examiner* — Scott Young
(74) *Attorney, Agent, or Firm* — Gerald E. Helget; Briggs and Morgan, P.A.

(57) ABSTRACT

An archery bow quiver for holding arrows for quick retrieval to be shot by the bow includes an integral bow hook and tree screw. The quiver, which quickly attaches and detaches to the riser of a bow, includes an elongate frame with a top end for a hood to protect the arrow tips or broadheads and a bottom end where at is suitably an elastomeric arrow shaft rack. In the central region of the elongate frame is a first cutout into which a pivotal collar or bushing is secured for acceptance of a journaled shaft further extending into a tree screw or spike. The journaled shaft is threaded into a bow hook end which extends in opposite direction from the tree screw. The bow hook and integral tree screw readily pivot within the cutout space to rotate transversely with respect to the elongate frame for rotation of the bow hook to screw the tree screw into suitably a tree. The bow hook suitably has a detent at its end for releasable locking engagement with a detent pin within the elongate frame suitably at a second cut out.

9 Claims, 4 Drawing Sheets

U.S. PATENT DOCUMENTS 6,948,694 B1 * 9/2005 Gilbert ..... 248/530
7,464,908 B2 * 12/2008 Files ..... 248/229.16
7,607,626 B2 * 10/2009 Whitmire ..... 248/309.1
7,857,279 B2 * 12/2010 Krasnicki ..... 248/545

* cited by examiner

ARCHERY BOW QUIVER

BACKGROUND OF THE INVENTION

This invention relates to an archery bow quiver and more particularly to an archery bow quiver with a bow hook and tree screw incorporated therewith.

In hunting with an archery bow, it is convenient to have a quantity of arrows readily available to the archer for fast reload. Thus, open rack quivers have been used which are attached to the bow on the side opposite the sight window. Early on, many of these quivers were attached in such a way that it was necessary to unscrew or unbolt the mount to remove the quiver from the bow. More recently, secure quiver mounts have been utilized which are rigid and secured to the bow, but will quickly allow the quiver to be attached or detached at the will of the archer by a simple finger motion.

However, quivers loaded with arrows add weight to the bow making it more difficult to hunt with the bow. When the bow is shot with the full complement of arrows held in the quiver, the force of releasing the string and nocked arrow may cause the arrows to vibrate resulting in noise that can scare away prey.

Most hunters and archers, after they have become physically situated, remove the quiver from the bow because the bow becomes bulky and somewhat awkward to maneuver especially if the hunter is hunting from a blind side. When in tree stands, bow hunters either screw a hook into the tree or find a short branch that may act as a hook to support the quiver while the hunter is in his tree stand. Problems do arise in the case where the quiver may be bumped and it falls out of the tree stand requiring the archer to climb down and retrieve it possibly disturbing the game the hunter is seeking.

Archery bow hangers are popular because they provide the archer with the ability to hang his bow at any time while in the woods or in a tree stand. The bow is always within reach and an arrow can be nocked while the bow is hanging so that the archer is ready to shoot at all times. The use of the archery bow hanger increases the enjoyment of hunting by freeing the archer's hands for other activities such as binocular usage, relaxation, eating and drinking. Bow hangers typically generally look like hooks with a threaded end which may be screwed into the tree or branch at the particular location convenient for the hunter.

There is a need for an archery bow quiver with a bow hook and tree screw incorporated therewith. By such an arrangement, the quiver can selectively be located and secured to a tree in a desired spot with arrows readily reachable by the archer as well as the quiver having a bow hook to conveniently allow the archer to hang his loaded bow thereon to free his hands. Incorporation of these features into one device will assist the archer quickly, conveniently, and safely in temporarily storing and locating his arrow quiver and bow hook where desired.

SUMMARY OF THE INVENTION

An archery bow quiver for holding arrows for quick retrieval to be shot by the bow includes an integral bow hook and tree screw. The quiver, which quickly attaches and detaches to the riser of a bow, includes an elongate frame with a top end for a hood to protect the arrow tips or broadheads and a bottom end whereat is suitably an elastomeric arrow shaft rack. In the central region of the elongate frame is a first cutout into which a pivotal collar or bushing is secured for acceptance of a journaled shaft further extending into a tree screw or spike. The journaled shaft is threaded into a bow hook end which extends in an opposite direction from the tree screw. The bow hook and integral tree screw readily pivot within the cutout space to rotate transversely with respect to the elongate frame for rotation of the bow hook to screw the tree screw into suitably a tree. The bow hook suitably has a detent at its end for releasable locking engagement with a detent pin within the elongate frame suitably at a second cut out.

A principal object and advantage of the present invention is that the archery quiver with integral bow hook and tree screw is a unitary one piece item which is not susceptible to loss by the archer.

Another object and advantage of the present invention is that it secures the quiver at a location in the tree desirable by the archer for quick and ready access to arrows and the bow.

Another object and advantage of the present invention is that the integral bow hook can be secured into the tree at a desirable location by the archer capable of supporting a loaded bow while freeing the hands of the archer and maintaining the arrows within the quiver within close proximity to the archer.

Another object and advantage of the present invention is that the tree screw and bow hook has a conical end with coarse threads making it easy for the archer to secure the quiver to a tree without the need of any additional tools.

Another object and advantage of the present invention is that the tree screw and bow hook pivots within the elongated frame of the quiver allowing it to be folded and locked into a secure safe position for storage as well as permitting it to be pulled out approximately ninety degrees transversely to the elongate frame for easy rotational securement into a tree.

Another object and advantage of the present invention is that the quiver has a quick release and mount bracket for securing the quiver onto the riser of a bow.

Another object and advantage of the present invention is that the archer will always retrieve his bow and quiver before descending from his tree stand, assuring that the archer would not forget his otherwise bow hook and quiver hook up in the tree after his descent.

Other objects and advantages will become apparent upon a study of the figures and following specification.

DETAILED SPECIFICATION

Figure 1:
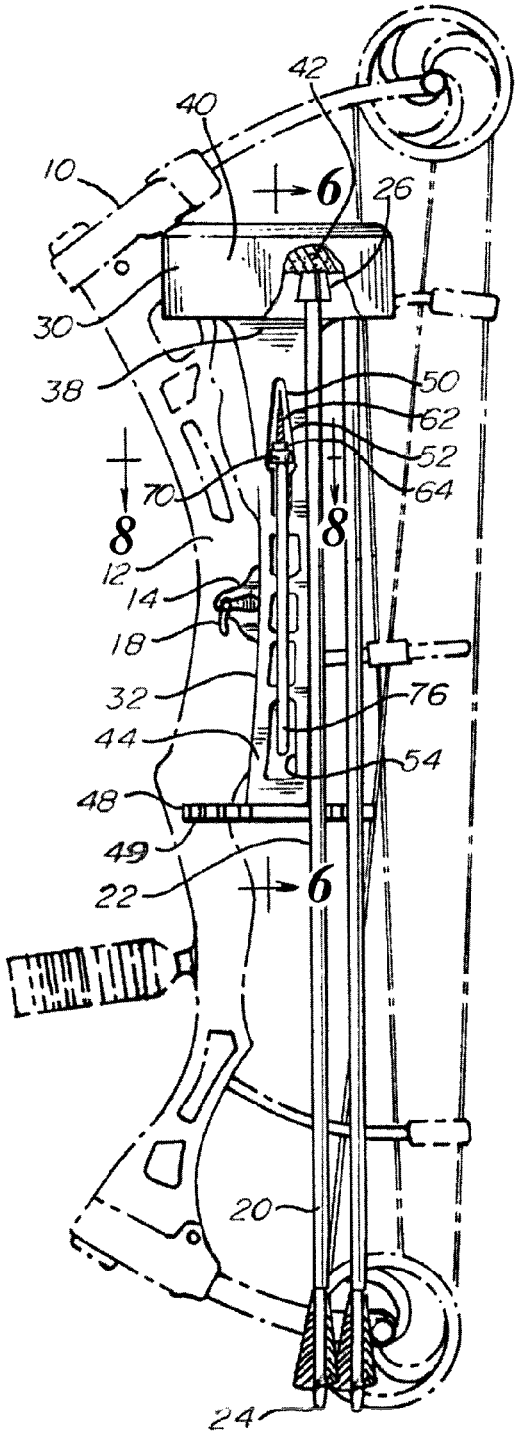
FIG. 1 is a rear elevational view of the quiver mounted on an archery bow shown in phantom outline.
Figure 2:
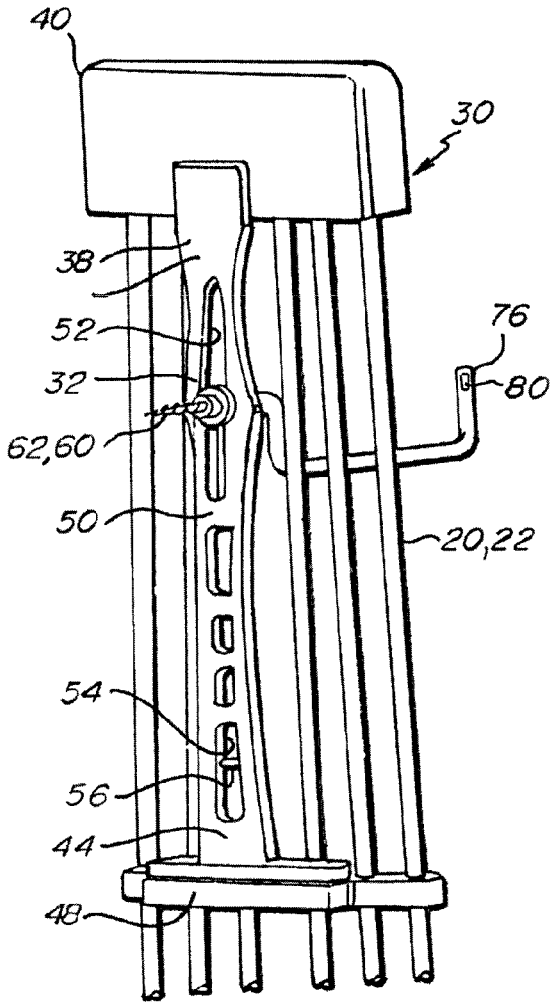
FIG. 2 is a rear elevational view of the quiver with the arrows therein broken away.

The archery quiver 30 with a tree screw 60 and a bow hook 76 may be generally understood by referring to FIGS. 1 and 2. For ease of understanding, an archery bow 10 comprises of riser 12 suitable for mounting the quiver 30. The archery bow 10 is intended for shooting arrows 20 which have an intermediate arrow shaft 22, a knock end 24 and suitable arrow points or broadheads 26.

The quiver 32 suitable has an elongate frame 32 which supports a hood 40 and an elastomeric arrow shaft holder 48. In the central region 50 of the elongate frame 32 is a first cut out 52 into which is mounted the tree screw 60/bow hook 76 assembly. A second cut out 54 is provided for rotation of the bow hook 76 there into to be secured by the bow hook detent 80 about detent pin 56. The tree screw 60 and bow hook 76 are joined together and are journaled within a pivotal collar or bushing 70 which will permit the tree screw 60 and bow hook 76 to rotate therein.

Figure 3:
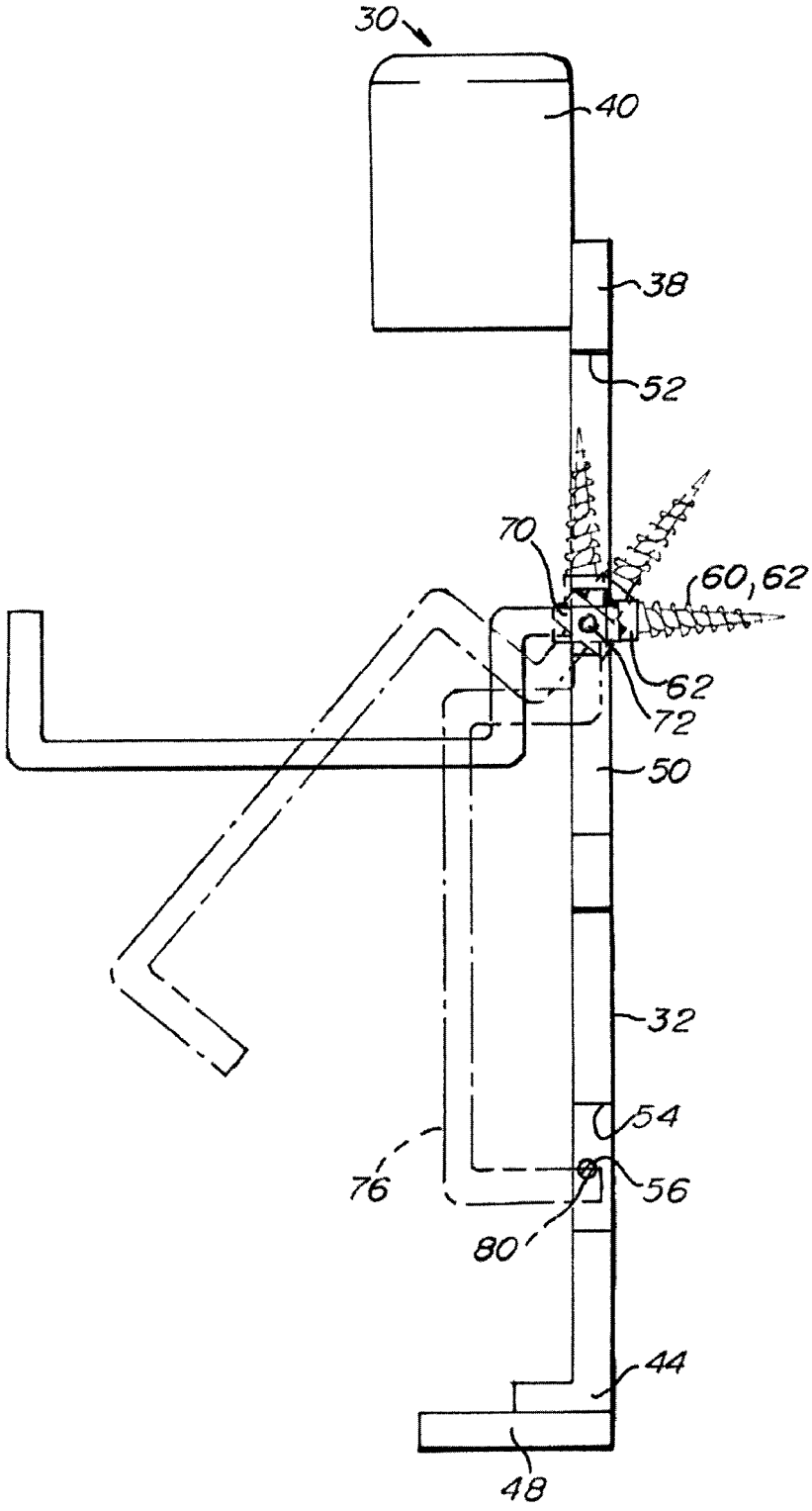
FIG. 3 is a right side elevational view of the quiver showing the pivotal movement of the tree screw and bow hook.
Figure 4:
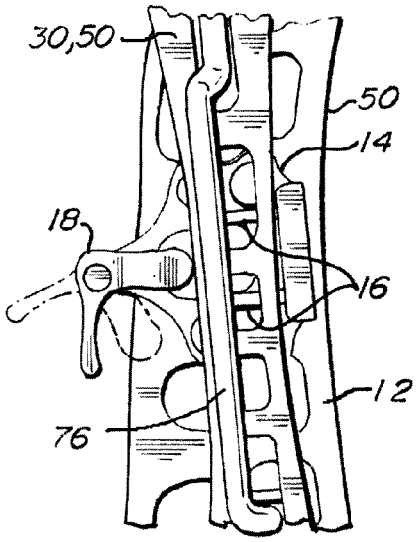
FIG. 4 is a front elevational view of the elongate frame of the quiver broken away showing the quiver secured to the riser of a bow with a quiver mount bracket.
Figure 5:
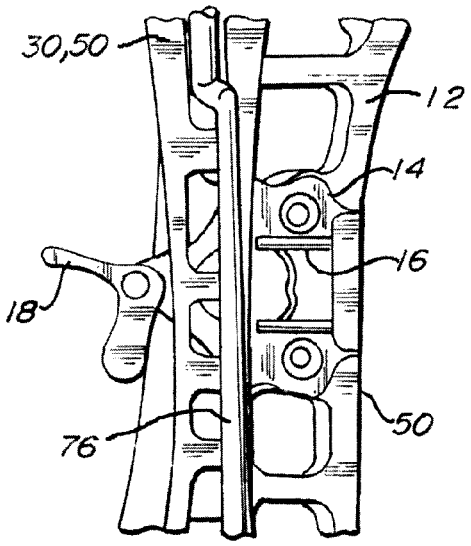
FIG. 5 is a view similar to FIG. 4 showing the detachment of the quiver from the mounting bracket on the riser of a bow.

FIG. 3 is a right side elevational view to show the pivoting from storage to operational condition of the tree screw 60 and bow hook 76 assembly rotatable within collar or bushing 70.

The details of the quiver 30 may be understood by a view of FIGS. 1 through 8 with particular attention to FIGS. 4 through 8.

Again, the quiver 30 has an elongate frame 32 with transverse pilot holes 36 (FIG. 7) which suitably will receive pins 16 of the quiver mount bracket 14 mounted on to the bow riser 12. A cam lock 18 is suitably used to lock the frame 32 into the bracket 14 which may be easily released with the flip of the cam lock 18 with a finger.

The quiver 30 has the elongate frame 32 at the top 38 supporting a hood or cup 40 for protection of the arrow points or broadheads 26. A resilient elastomeric or foam insert block 42 may be used to firmly hold the broadheads 26. The bottom end 44 of the frame 32 has mounted thereon a resilient elastomeric holder 48 which suitably may be a rack for the arrow shafts 22 comprising slots 49 surrounded by flexible fingers that grasp and hold the arrow shaft 22. Spring clips may also be used to hold the arrow shafts 22.

Within the central region 50 of the quiver 30 is a first cutout 52 for mounting of the joined tree screw 60 and bow hook 76. A second cutout 54 there below is for the mounting of detent pin 56 which catches the detent 80 on bow hook 76 to secure the tree screw 60 and bow hook 80 in a locked, secure, safe position.

Figure 6:
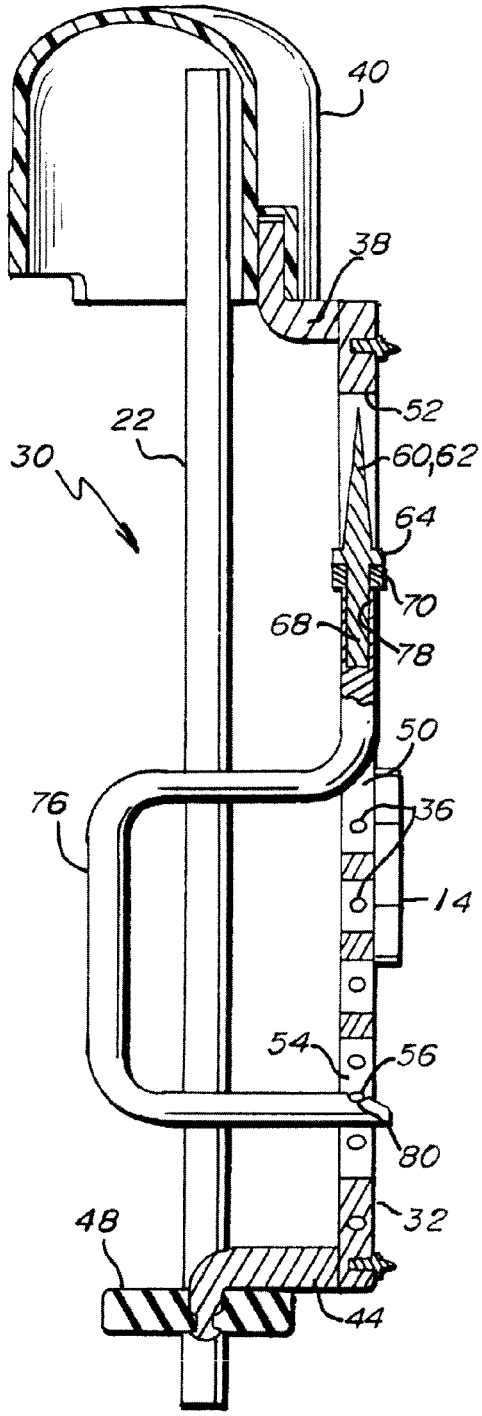
FIG. 6 is a view taken along lines 6-6 of FIG. 1 with the bow hook and tree spike shown in storage position.
Figures 7, 8:
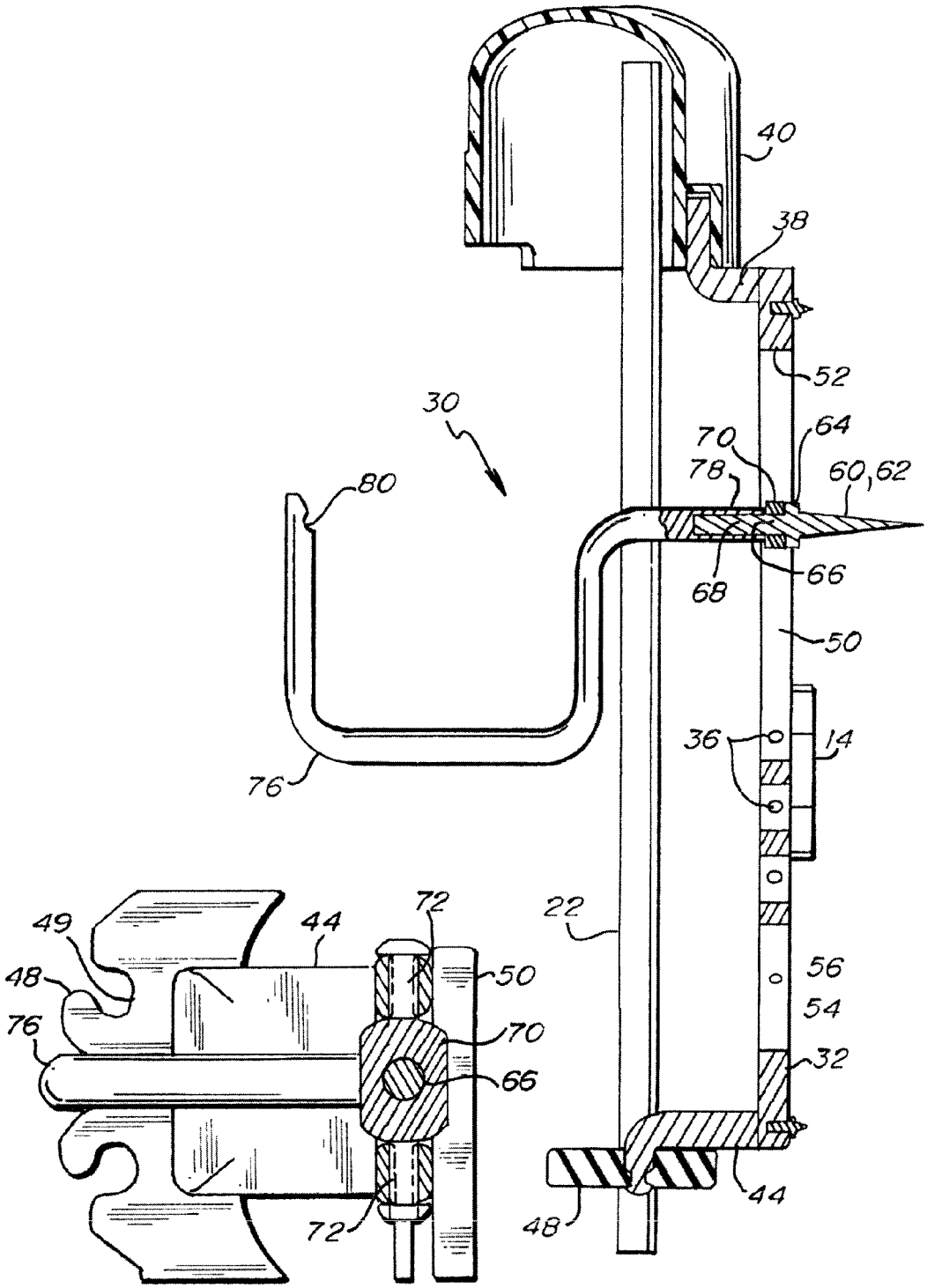
FIG. 7 is a similar view to FIG. 6 with the bow hook and tree spike shown in operational condition.
FIG. 8 is a sectional view of the quiver taken along lines 8-8 of FIG. 1.

The details of the tree screw 60 and bow hook 76 assembly and mounting within the first cutout 52 of the central region 50 of the elongate frame may be clearly appreciated with a view to FIGS. 6 through 8. The tree screw 60 has a conical end 62 with coarse threads for rotational penetration into a tree. Opposite the conical end 62 is a journaled shaft 66 having a stop collar or ring 64 and a threaded end 68. The shaft 66 is rotationally mounted in the pivotal collar or bushing 70 and held thereat from one side by stop collar or ring 64. Opposing horizontal pins or threaded screws 72 secure the collar 70 in the first cutout for pivotal movement up and down from the folded collapsed unused condition (FIG. 6) and the operational condition (FIG. 7). Bow hook 76 has an internally threaded end 78 into which the threaded end 68 of the tree screw is secured after it has been passed through the rotational collar or bushing 70. The threaded end 78 abuts up against collar 70 to finish holding the bow hook 76 and tree screw 60 rotationally free but confined within the collar 70. The bow hook 76 has a detent 80 which will secure to the detent end 56 in the second cutout 54.

In operation, the quiver 36 mounted onto riser 12 of an archery bow 10 may be removed from the bow 10 by finger movement of the cam lock 18. The pins 16 in the quiver mount bracket 14 may then be withdrawn from pin pilot holes 36 to detach the quiver 30 from the bow 10.

The bow hook 80 is grasped and pulled outwardly to release the detent 80 from the detent pin 56 and rotated upwardly approximately 90 degrees transverse to the elongate frame 32. With the tree screw 60 and joined bow hook 76 journaled in collar or bushing 70, the bow hook 76 may be rotated to drive the tree screw 60 with leverage into a tree in a desired, suitable location next to the archery hunter. After the quiver 30 is secured to the tree, the archer may place his bow 10 onto the bow hook 76 with the bow 10 loaded or unloaded with an arrow 20. Additional arrows 20 within the quiver 30 are conveniently located with the quiver 30 that supports the bow 10.

The preceding description and accompanying figures are for illustrative purposes only. The true scope of the claims is to be determined by a reading of the claims hereinafter.

What is claimed is:

1. An archery bow quiver attachable to a bow with an arrow holder for holding arrows by their shafts and protecting arrow broadheads with a hood, the quiver comprising:

a) an elongate frame with the hood at one end and the arrow holder at the other end;

b) a combination unitary in-line bow hook and tree screw pivotally and rotationally mounted to the elongate frame as to permit the in-line bow hook and tree screw to lie along the frame when not in use and to pivot transversely to the frame to rotationally screw into a tree to hold the quiver to a tree and permit the bow to be hung on the bow hook; and c) a central cut out in the elongate frame into which the in-line bow hook and tree screw is recessed and pivotally mounted, wherein the in-line bow hook and tree screw are rotably journaled into a collar pivotally mounted in the central cut out.

2. The archery bow quiver of claim 1, wherein an abutment on the bow hook and a stop ring on the tree screw securely capture the pivoting collar.

3. The archery bow quiver of claim 1, further comprising a second cut out for receiving and holding a detent on a distal end of the bow hook.

4. The archery bow quiver of claim 1, wherein the tree screw is conical in shape.

5. An archery bow quiver attachable to a bow with an arrow holder for holding arrows by their shafts and protecting arrow broadheads with a hood, the quiver comprising:

a) an elongate frame with the hood at one end and the arrow holder at the other end and a central cut out; and b) a combination unitary in-line bow hook and tree screw pivotally and rotationally mounted into the recess of the elongate frame as to permit the in-line bow hook and tree screw to lie recessed along the frame when not in use and to pivot transversely to the frame to rotationally screw into a tree to hold the quiver to a tree and permit the bow to be hung on the bow hook wherein the in-line bow hook and tree screw are rotably journaled into a collar pivotally mounted in the central cut out.

6. The archery bow quiver of claim 5, wherein an abutment on the bow hook and a stop ring on the tree screw securely capture the pivoting collar.

7. The archery bow quiver of claim 5, further comprising a second cut out for receiving and holding a detent on a distal end of the bow hook.

8. The archery bow quiver of claim 5, wherein the tree screw is conical in shape.

9. An archery bow quiver attachable to a bow with an arrow holder for holding arrows by their shafts and protecting arrow broadheads with a hood, the quiver comprising:

a) an elongate frame with the hood at one end and the arrow holder at the other end and a central cut out;

b) a combination unitary in-line bow hook and tree screw; and c) a collar pivotably mounted in the central recess wherein the in-line bow hook and tree screw is rotably journaled into collar as to permit the in-line bow hook and tree screw to lie recessed along the frame when not in use and to pivot transversely to the frame to rotationally screw into a tree to hold the quiver to a tree and permit the bow to be hung on the bow hook and a second cut out for receiving and holding a detent on a distal end of the bow hook as to secure the bow hook and tree screw recessed when not in use.

* * * * *